US008662810B2

(12) United States Patent
Abegglen

(10) Patent No.: US 8,662,810 B2
(45) Date of Patent: Mar. 4, 2014

(54) METHOD AND DEVICE FOR MANUFACTURING ADHESIVELY BOUND PRINTED PRODUCTS FORMED OF A BOOK BLOCK AND A COVER

(75) Inventor: Peter Abegglen, Frauenfeld (DE)

(73) Assignee: Müller Martini Holding AG, Hergiswil (CH)

( * ) Notice: Subject to any disclaimer, the term of this patent is extended or adjusted under 35 U.S.C. 154(b) by 270 days.

(21) Appl. No.: 13/326,841

(22) Filed: Dec. 15, 2011

(65) Prior Publication Data

US 2012/0155992 A1 Jun. 21, 2012

(30) Foreign Application Priority Data

Dec. 17, 2010 (CH) ..... 2114/10

(51) Int. Cl.

| | |
|---|---|
| ***B42C 11/00*** | (2006.01) |
| ***B42C 13/00*** | (2006.01) |
| ***B42C 11/02*** | (2006.01) |
| ***B42C 11/04*** | (2006.01) |

(52) U.S. Cl.

USPC ..... 412/14; 412/4; 412/5; 412/11; 412/19; 412/21

(58) Field of Classification Search

USPC ..... 412/4–5, 11, 13–14, 19–21

See application file for complete search history.

(56) References Cited

U.S. PATENT DOCUMENTS

| | | | | |
|---|---|---|---|---|
| 7,210,887 | B2 * | 5/2007 | Engert et | 412/20 |
| 2008/0199276 | A1 * | 8/2008 | Graushar et al. | 412/4 |
| 2009/0155022 | A1 * | 6/2009 | Garlichs et al. | 412/21 |
| 2011/0170987 | A1 * | 7/2011 | Hartshorne et al. | 412/4 |

FOREIGN PATENT DOCUMENTS

| | | |
|---|---|---|
| CH | 475098 | 7/1969 |
| CH | 586115 | 3/1977 |
| DE | 10221542 | 11/2003 |

* cited by examiner

*Primary Examiner* — Kyle Grabowski

(74) *Attorney, Agent, or Firm* — Lucas & Mercanti, LLP; Klaus P. Stoffel

(57) ABSTRACT

Method and device for manufacturing adhesively bound printed products composed of a book block and a cover, in which the book block is conducted past processing stations of the adhesive binding device for processing and applying glue to its back. A cover is supplied to the back to which glue has been applied in a synchronously timed controlled manner. After merging of the cover with the book block, a measuring procedure for measuring a mutual actual position of cover relative to book block. Subsequently, this actual position is compared to a predetermined desired position, and, in the case of deviations, a correction value is determined and stored. Prior to the renewed occurrence of the pairing of drive member and clamp, an appropriate change of the mutual positions of clamp and drive member is carried out.

10 Claims, 3 Drawing Sheets

METHOD AND DEVICE FOR MANUFACTURING ADHESIVELY BOUND PRINTED PRODUCTS FORMED OF A BOOK BLOCK AND A COVER

CROSS-REFERENCE TO RELATED APPLICATIONS

The present application claims priority of CH 02114/10, filed Dec. 17, 2010, the priority of this application is hereby claimed and this application is incorporated herein by reference.

BACKGROUND OF THE INVENTION

The invention relates to a method and a device for manufacturing adhesively bound printed products formed of a book block and a cover, in which the book blocks are each conveyed past processing stations of the adhesive binding device in one of several circulating clamps of an adhesive binding device for processing and applying glue to their backs. Subsequently, a cover is supplied with synchronized timing to the back which has been provided with glue. In that case, after the cover has been combined with the book block, a measuring procedure for determining a mutual actual position of the cover relative to book block is provided.

In the industrial manufacture of adhesively bound printed products, such as magazines, catalogs, paperbacks or similar products, in a first step printed sheets are gathered into loose book blocks, and are subsequently processed in an adhesive binder in the back area thereof, and are provided with glue and glued together with the cover. In this connection, quickly running adhesive binders have a plurality of clamps which are arranged with regular spacings and circulate in a closed track, wherein the loose book blocks are clamped and transported in the longitudinal direction of the backs from a feeding station to a release station. The drive of the clamps can be effected through pulling means driven by a drive wheel, wherein the clamps are attached to the pulling means, or directly through racks arranged at the clamps, wherein the racks are drivable through a drive gear. By means of stationary processing stations arranged between the feeding station and the release station, such as, for example, back processing stations, gluing stations, cover stations, and pressing stations, the book blocks protrude slightly with their back areas downwardly from the clamps and are processed while they are being conveyed. One of the last processing stations in an adhesive binder is the cover station. The accuracy by which the covers can be placed in the longitudinal direction of the backs relative to the book block constitutes a significant quality feature of a bound printed product. After being supplied to the clamps, the book blocks are precisely aligned in the longitudinal direction of the back. By means of a conveyer circulating in a closed track the covers are conveyed to the merging location of cover and book block and are pressed by a pressing station from below against the book block back and on the sides. The drive of the cover conveyer is connected either mechanically or is connected through its own drive synchronously to the drive of the clamps. The achievable accuracy of cover relative to book block is significantly impaired by defects in the drive means, primarily the pulling means of the drive means, caused by manufacturing inaccuracies and wear. In addition, the accuracy can be negatively influenced by changing production conditions, such as production speed, glue film thickness, glue application, temperature or the force with which the covers are pressed.

CH 475098 A5 describes a method in which the position of the covers in relation to the book blocks is controlled by an adaptation of the supply units of the covers to the clamps. The supply units are arranged at a cyclically operating pressing station and are aligned relative to the clamp before the cover is merged with the book block. A relatively short time window is available for this alignment procedure, so that, in the case of high cycle numbers, the cover can be deformed by high accelerations and, thus, the expected alignment accuracy can no longer be achieved, CH 586115 A5 describes a method in which higher cycle numbers are possible by referencing a cover conveying chain directly at a clamp, so that the cover can be aligned relative to the book block. Even if the accelerations and the resulting negative effects on the printed products are reduced, this method is not suitable for cycle numbers above 12,000 cycles/h.

In DE 10221542 A1 a device is disclosed in which the clamps and at least one processing station are drivable independently of each other. In this connection, a measuring system for determining the position of the clamps or of the book blocks is provided in the vicinity of this processing station for the control thereof in the sense of a positioning task. As a result, a processing station, for example, the supply of covers to the clamp or to the book block can be aligned.

When using the solutions according to the prior art, deviations of the covers relative to the book block, caused by tolerances in the drives and pulling means for driving the clamps and the feeding of the covers, car only be prevented before they are combined. Deviations which occur during and/or after the combining of the covers with the book blocks, cannot be determined or compensated by means of devices according to the prior art. Such deviations can be caused, for example, by changes of parameters such as, production speed of the adhesive binder, the film thickness or the application temperature of the adhesive and the pressing force of the cover against the book block.

SUMMARY OF THE INVENTION

It is the object of the invention to provide a method and a device for manufacturing adhesively bound printed products by means of which a precise relative position of the cover in the longitudinal direction of the back is ensured even in the case of changed production conditions.

In accordance with the invention this object is met in that the cover station includes a drive member which feeds the cover to the book block, the actual position of the cover relative to the book block is compared with a predetermined set position, and, in the event of deviations of the actual position from the set position a correction value is determined for a specific pairing of the drive member which transports the detected cover. This correction value is stored and, before the specific pairing of drive member and clamp occurs once again, a change of the position of the clamp and/or the drive member of this pairing corresponding to the correction value is carried out.

Consequently, this method facilitates a correction of deviations which may be caused by changes of the production conditions, as well as by extended drifting which occurs due to wear of drive elements.

The processing stations include a pressing station and a release station arranged downstream. Preferably, in this method the respective actual position of cover to book block are correspondingly determined from the actual values measured by the measuring device downstream of the pressing station and, particularly advantageously between the pressing station and the release station.

In a device according to the invention for manufacturing adhesively bound printed products formed of a book block and a cover, the cover station includes a drive member for feeding the cover to a book block which is transported in a clamp. In this connection, the drive member supplying the cover and the clamp transporting the book block constitute a specific pairing. The adhesive binding device of the device in accordance with the invention also includes an evaluating and control unit in which a predetermined set position of the cover relative to the book block can be stored, can be compared to the actual position of the cover relative to the book block, a deviation of the actual position from the set position can be detected, a correction value for the specific pairing can be determined and stored. Prior to the renewed occurrence of the specific pairing of drive member and clamp, the evaluating and control unit determines a change of the position of the clamp and/or the drive member of this pairing corresponding to the correction value and is passed on to a principal drive of the clamps connected to the evaluating and control unit and/or is passed on to the drive device of the cover station.

In a further development of the device, the drive device has a superimposed gear unit connected to a distributing gear by a kingpin and an electric motor.

In a different embodiment of the device, the electro-motor is a stepper motor or servomotor controlled by the angle of rotation and connected with a motor control connected to the evaluating and control unit.

Preferably the inventive device has a reference time sensor connected to the principal drive, and a drive sensor for determining an impulse with passing of the receiver.

In accordance with another further development of the device, the latter includes a reference cycle generator for producing a pulse at the reference timing sensor during each machine cycle, wherein, the reference cycle generator is driven through a reference gear unit.

In a further development of the device, the measuring device is preferably arranged downstream of the pressing station and, particularly advantageously between the pressing station and release station.

The various features of novelty which characterize the invention are pointed out with particularity in the claims annexed to and forming a part of the disclosure. For a better understanding of the invention, its operating advantages, specific objects attained by its use, reference should be had to descriptive matter in which there are described preferred embodiments of the invention.

DETAILED DESCRIPTION OF THE INVENTION

Figure 1:
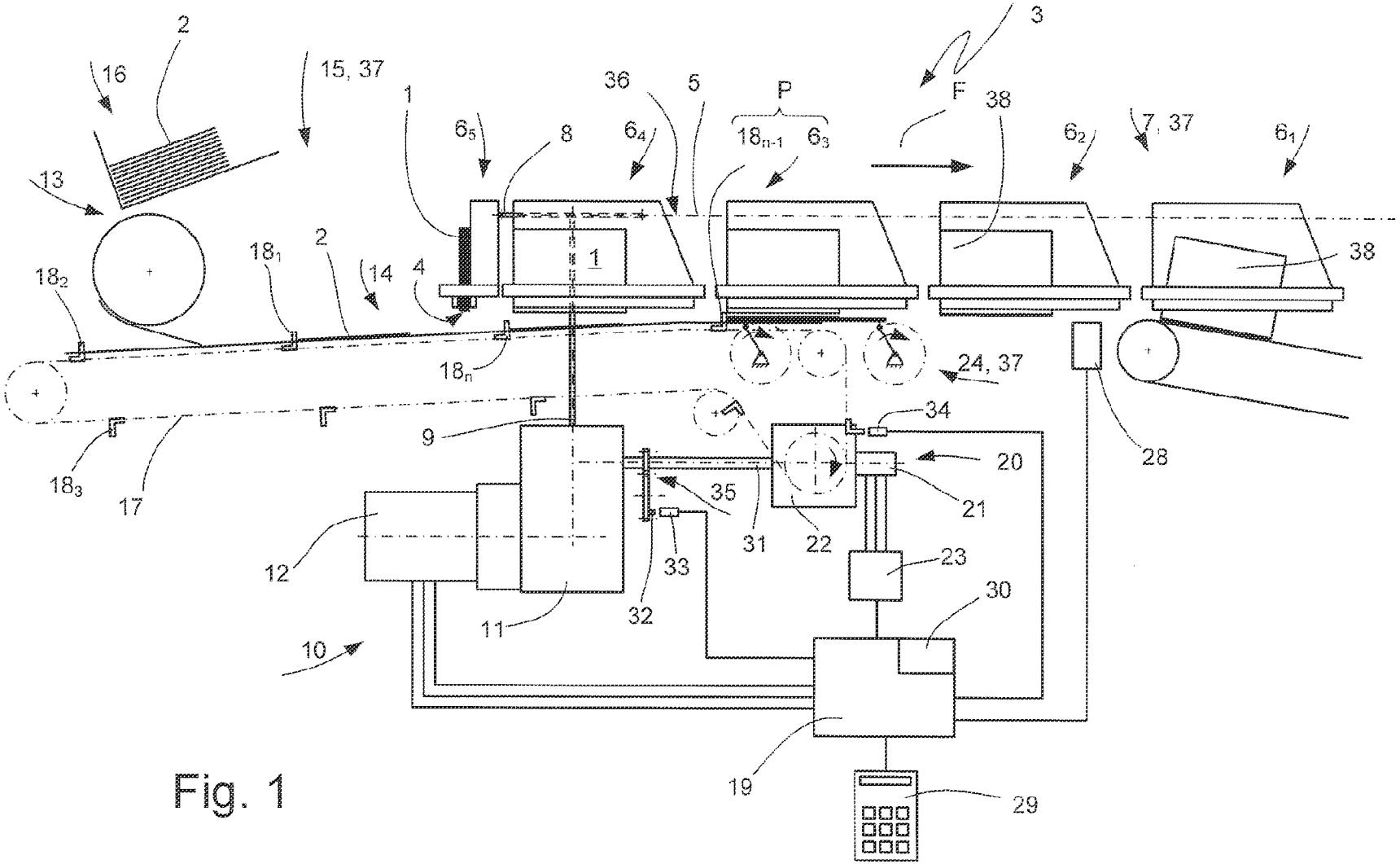
FIG. 1 is a schematic illustration of a device according to the invention in a first embodiment.

As illustrated in FIG. 1, for manufacturing adhesively bound printed products 38 composed of a book block 1 and a cover 2, such as books, brochures, magazines, etc., printed products are initially gathered into loose book blocks 1 in a gathering machine. Subsequently, the book blocks are bound in an adhesive binding device 3 in the area of their backs 4. The adhesive binding device 3 arranged downstream includes clamps 6 which are driven through a pulling means 5 and circulating in a closed track at regular spacings, wherein the book blocks 1 are fed to the clamps 6 for processing the backs by gluing, and for placing the covers 2. All process steps take place by means of processing stations 37, only partially illustrated, arranged stationary along a conveying path 36 of the clamps 6, wherein the book blocks 1 slightly protrude downwardly with their backs 4 beyond the clamps 6 while they are conveyed in a conveying direction F. The conveying path 36 corresponds to the path between a feeding station, not shown, which feeds the book blocks 1 into the clamps 6 and a release station 7 in which the bound printed products 38 are removed from the clamps 6. The pulling means 5 is driven by a drive wheel 8 which is connected through a drive shaft 9 to a principal drive 10 of the adhesive binding device 3.

In a first embodiment according to FIG. 1, the principal drive 10 includes a distributing gear unit 11 and a principal motor 12 which drives the distributing gear unit 11. A cover station 15 formed essentially by a cover feeder 13 and a cover supply 14 conveys the covers of the book blocks 1 in a synchronously timed manner by means of drive members 18 fastened to a chain 17 and, thus, forms one of the last processing stations 37 of the adhesive binding device 3.

By means of a pressing station 24 arranged downstream of the cover station 15, the covers 2 are pressed from below against the backs 4 of the book block 1 and laterally against the book blocks 1, wherein the covers 2 and/or the book blocks 1 are coated with adhesive prior to pressing. At the end of the conveying path 36 of the clamps 6, i.e., after the pressing station 24, a measuring device 28 for determining the mutual positions of cover 2 and book block 1 is provided along the back 4. The actual values I determined by the measuring device 28 are transmitted to an evaluating and control unit 19 connected to the measuring device 28, wherein these values are compared to a set value S and correction values K are determined. The formation of the correction values K is explained following the description of the device.

Figure 2:
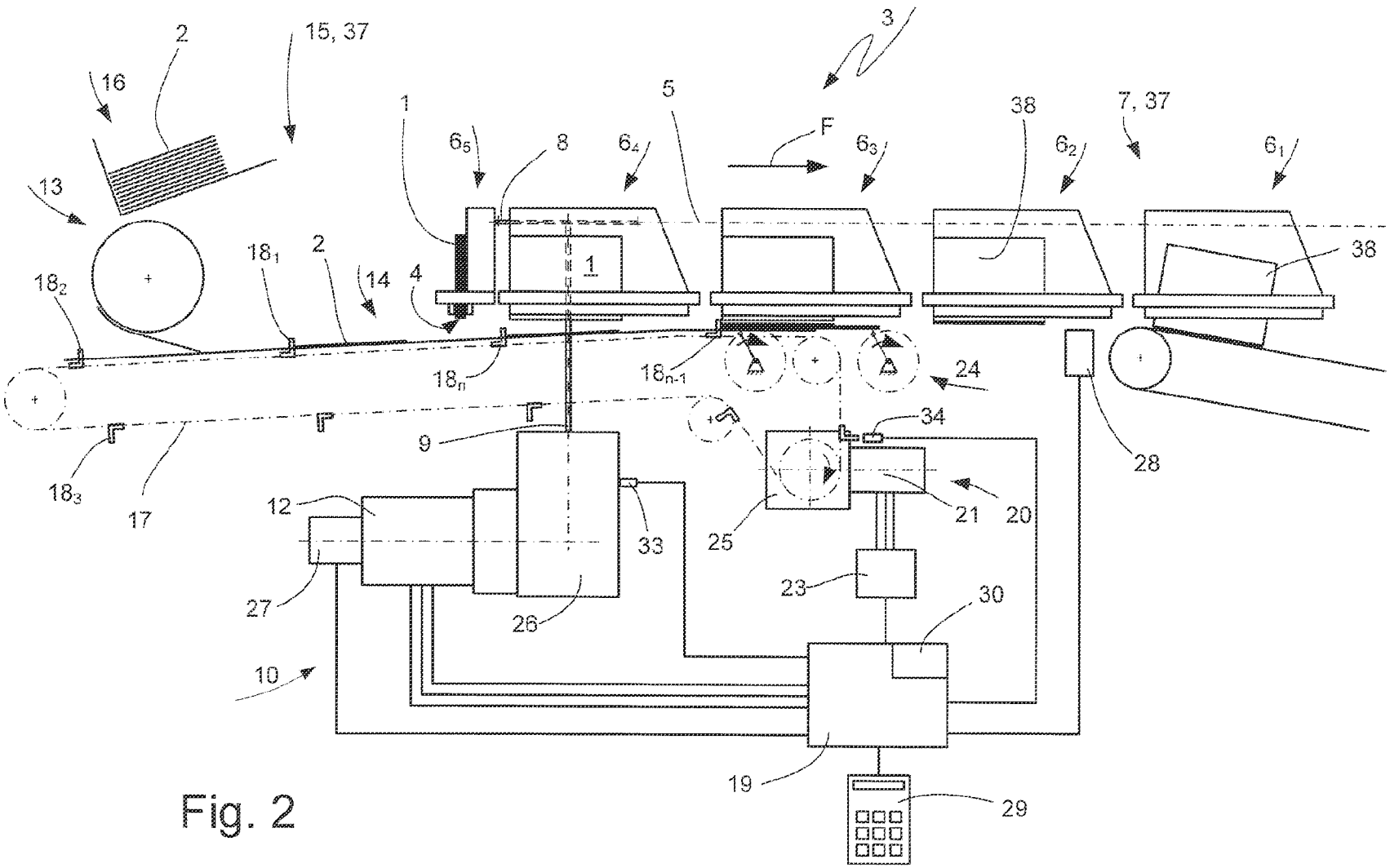
FIG. 2 is a schematic illustration of a device according to the invention in a second embodiment.

In FIG. 1 and FIG. 2 the measuring device 28 is arranged after the pressing station 24, i.e., the second to last processing station 37. However, the measuring device 28 could also be arranged after the release station 7. As a result, the printed product 38 located in the area of the measuring station 28 can be assigned unequivocally to a pairing P of a clamp 6 with a drive member 18.

The covers 2 stacked on top of each other in a magazine 16 of the cover feeder 13 are separated by the cover feeder 13 and transferred to the cover supply 14. This supply has n drive members 18 which are fastened to the circulating chain 17 at regular spacings. The chain 17 is driven with synchronous timing to the clamps 6 through a drive device 20 assigned to the cover feeder 13 and connected to the evaluating and control unit 19. The drive device 20 is formed by a superimposed gear unit 22 connected to the distributing gear 11 through a kingpin 31 and an electric motor 21. The superimposed gear unit 22 adds the angle of rotation produced by the electric motor 21 constructed as a servomotor and is assigned to the superimposed gear unit 22 to the angle of rotation of the distributing gear unit 11.

The electric motor 21 is preferably constructed as a step motor or servomotor controlled by the angle of rotation, wherein the step motor or servomotor is connected to a motor control 23 which in turn is connected to the evaluating and control unit 19. By using the electric motor 21, corrections can be made on the mutual positions of the drive members 18, or of the covers 2 relative to the clamps 6, or the book blocks 1 clamped in the clamps 6. This takes place immediately before merging of the covers 2 with the book blocks 1 by means of the pressing station 24. These corrections are based on the actual positions, determined by the measuring device 28, of the covers 2 relative to the book blocks 1 of previously supplied printed products 38.

When the evaluating and control unit 19 is switched off it loses the control over the position of the drive members 18 relative to the clamp 6. Consequently, after the evaluating control unit 19 has been switched on again the latter does not know the position of the drive members 18 relative to the clamps 6, so that initially printed products 38 are produced with undefined position of the covers 2 to the book blocks 1, until after a measurement of the deviations by means of the measuring device 28, the deviations are compensated by the evaluating and control unit 19.

In order to be able to achieve a defined position of the covers 2 relative to the book blocks 1 already at the beginning of a production, means are provided for a basic adjustment of drive members 18 relative to the clamps 6. In accordance with FIG. 1, these means are a reference timing sensor 33 connected with the principal drive 10 and a drive member sensor 34 which produces a pulse when passing the drive members 18. A reference cycle generator 32 is driven through a reference gear unit 35 in such a way that it triggers a pulse at the reference timing sensor 33 during each machine cycle. For synchronizing, initially the principal drive 10 is moved into that position in which the reference timing sensor 33 receives a pulse. Subsequently, the drive device 20 is moved up to that position in which the drive member sensor 34 receives a pulse. The synchronization can take place with the adhesive binder device 3 being empty, so that the covers 2 can be fed to the book blocks 1 at the correct position already in the first printed products 38 to be manufactured.

As illustrated in FIG. 2, in a second embodiment the drive device 20 has an electric motor 21 controlled by the angle of rotation, wherein the electric motor 21 drives the chain 17 directly or through a gear unit 25 arranged therebetween. Through a reduction gear unit 26, the principal drive 10 exclusively drives the pulling means 5 or the clamps 6. For a synchronous running of the chain 17, i.e., the drive members 18, relative to the clamp 6 a resolver 27 constructed as a position sensor and connected to the evaluating and control unit 19 is provided at the principal motor 12, wherein the resolver 27 permanently determines the angle of rotation of the principal motor 12.

On the basis of the angle of rotation of the principal motor 12, the electric motor 21 synchronously follows the principal motor 12. Consequently, the principal drive 10 forms the master drive which is followed by the drive device 20 as a slave drive. Such systems are also known under the name "electric wave." Depending on the type of electric motor 21, it is also possible to couple a resolver to the drive shaft of the electric motor, wherein the resolver is connected to the evaluating and control unit 19 or to the motor control 23. Analogously to the first embodiment, a reference cycle generator, not illustrated in the reference timing sensor 33, produces a pulse per machine cycle. The synchronization of the drive members 18 with the clamps 6 can also take place analogously to the description of the first embodiment.

In the following, a method is described by means of which a precise position of the covers 2 relative to the book blocks 1 is achieved in the longitudinal direction of the back 4. The actual values I continuously determined by the measuring device 28 are compared to a set value S which was fed to the operating unit 29 and stored in the evaluating and control unit 19. The deviations are assigned to the pairings P of the participating clamps 6 and the drive members 18. On the basis of these deviations, the evaluating and control unit 19 computes for the respective combination of a clamp $\mathbf{6}_m$ and of a drive member $\mathbf{18}_n$, a correction value $K_{m.n}$ for a pairing $P_{m.n}$ which is stored in a data bank of the evaluating and control unit 19.

Figure 4:
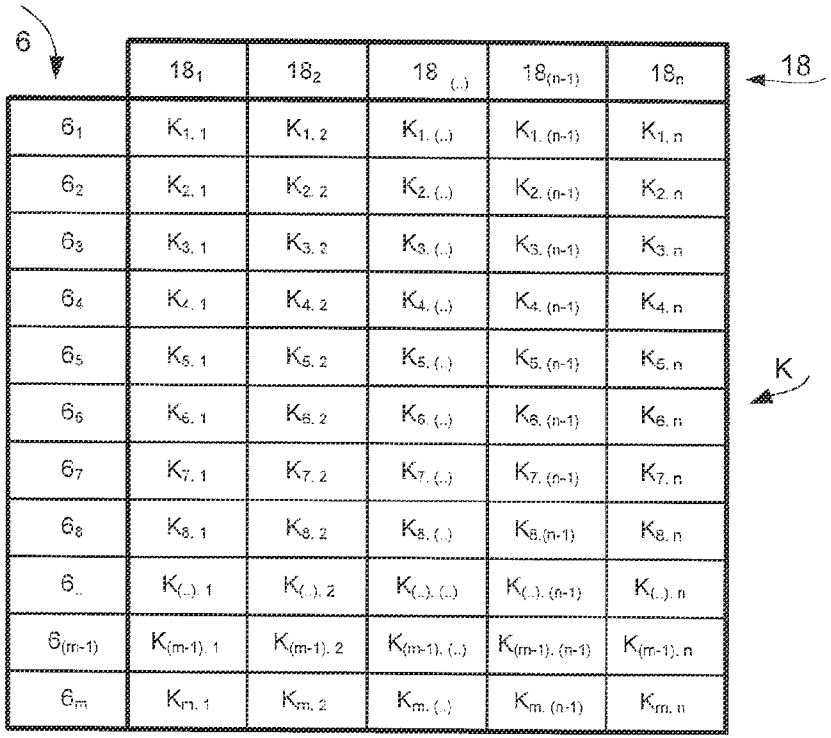
FIG. 4 is a table containing correction values.

FIG. 4 shows in the form of a table the correction values $K_{1.1\ldots m.n}$ assigned to the pairings P of clamps $\mathbf{6}_{1\ldots m}$ and drive members $\mathbf{18}_{1\ldots n}$. At a new adhesive binding device 3, the correction values $K_{1.1\ldots m.n}$ can be set at any chosen value because they are automatically corrected during the production. However, the correction values should be set at a value which approximately corresponds to the actual value I.

If the adhesive binding device 3 has m clamps 6 and the chain 17 has n drive members 18, the maximum possible number of pairings of clamps 6 and drive members 18 results as the product of the number m of the clamps 6 multiplied with the number n of the drive members 18. To each of these pairings P is assigned at least one storage station provided with a computer 30 or an evaluating and control unit 19 in which a previously determined correction value $K_{1.1\ldots m.n}$ is stored which becomes effective immediately prior to the next meeting of clamp 6 and drive member 18 of the same pairing P.

Figure 3:
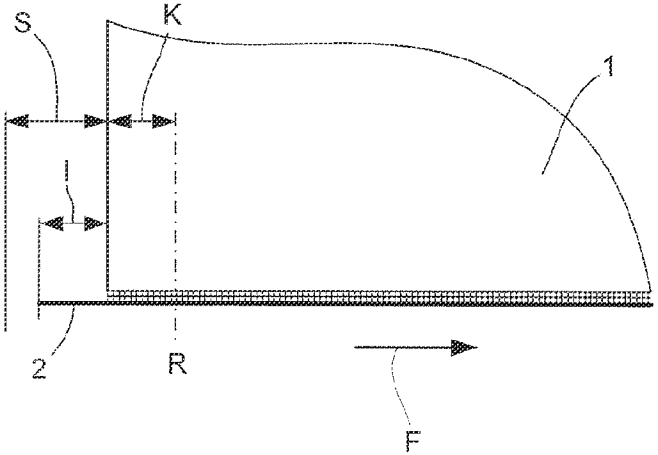
FIG. 3 shows a detail of the back portion of a book block, and connected to a cover.

In FIG. 3, the rear area of the book block 1 is illustrated with cover 2 attached thereto. The dimension S corresponds to the set value S, by which the cover 2 is to project beyond the book block 1 and the dimension I corresponds to the actual value I, which is measured by means of the measuring device 28. The position of the cover 2 relative to the book block 1 has a deviation of S−I. After each measurement, the correction value $K_{1.1\ldots m.n}$ is newly computed, for example, using the following formula:

$$\text{correction value (new)}=\text{correction value (old)}+\text{multiplier M times } (S-I),$$

which corresponds to a proportional regulation. Also conceivable are other regulators known from regulating technology. As a reference mark R, a pulse is assumed within a machine cycle which is produced either directly or indirectly by means of the principal drive 10, for example, a pulse of the reference timing sensor 33.

The method is subsequently described in the following in connection with an example with the following assumptions:

$$S=3\text{ mm};\ I=1\text{ mm};\ K_{4.3}=3\text{ mm};\ M=0.5.$$

A cover 2 is fed to the book block 1 by means of the drive member $\mathbf{18}_3$ to the book block 1 conveyed by the clamp $\mathbf{6}_4$. The correction value $K_{4.3}$ valid for this pairing $P_{4.3}$ is stored in the evaluating and control unit 19. The drive device 20 is adjusted relative to the pulse of the reference timing sensor 33 by $K_{4.3}$+S=6 mm. The actual value I subsequently measured at the product is 1 mm and, thus, the deviation S−I=2 mm. The new correction value $K_{4.3new}$ becomes $K_{4.3old}$+M*(S−I)=3+0.5*(3−1)=4 mm. When the pairing $P_{4.3}$ of clamp $\mathbf{6}_4$ and drive members $\mathbf{18}_3$ meet again with respect to time, the same method is carried out with a new correction value $K_{4.3new}$, and so forth. Any chosen value between 0 and 1 can be assigned to the multiplier M. With a smaller multiplier M the regulation becomes slower and with a larger multiplier M faster. Preferably, a value of 0.5 is selected for the multiplier. Using the described method, it is possible to correct deviations caused by the change of production conditions as well as extended drifting caused by, for example, wear of the drive elements. For operating and inserting the relevant parameters, the evaluating and control unit 19 is connected to the operating unit 29.

The use of the method described for the adhesive binding device 3 is not limited to this application. For example, it can also be used for placing glued covers in stitchers in the manufacture of so-called "Square Backs" or for placing protective covers into protective cover machines.

While specific embodiments of the invention have been shown and described in detail to illustrate the inventive principles, it will be understood that the invention may be embodied otherwise without departing from such principle.

I claim:

1. A method for manufacturing adhesively bound printed products formed of a book block and a cover, comprising the steps of: initially conducting the book blocks in one of several circulating clamps of an adhesive binding device past processing stations of the adhesive binding device for processing and application of glue to backs of the book blocks; supplying a cover in a synchronously timed and controlled manner by a cover station to the back to which glue has been applied; and, after merging the cover with the book block, carrying out a measuring process for detecting a mutual actual position of the cover relative to the book block, wherein the cover station includes a drive member which feeds the cover to the book block, the measuring process including comparing the actual position of the cover relative to the book block to a predetermined desired position, in the case of deviations of the actual position from the desired position, determining a correction value for a specific pairing of the drive member transporting the detected cover and the clamp transporting the detected book block, storing the correction value, and, prior to a renewed occurrence of the specific pairing of drive member and clamp, carrying out a change of the position of the clamp and/or the drive member of this pairing corresponding to the correction value.

2. The method according to claim 1, wherein the processing stations include a pressing station and a downstream release station, the method including measuring the actual values corresponding to the respective actual position of the cover relative to the book block downstream of the pressing station by a measuring device.

3. The method according to claim 2, including measuring the actual values between the pressing station and the release station.

4. A device for manufacturing adhesively bound printed products formed of a book block and a cover, comprising:

processing stations for processing and applying glue to a back of the book block and for placing and pressing a cover onto the book block;

a plurality of circulating clamps for conducting the book blocks past the processing stations;

a principal drive of the clamps;

a cover station for a synchronously timed controlled supply of a cover to the back of the book block onto which glue has been applied;

a measuring device for detecting a mutual actual position of the cover relative to the book block, wherein the cover station has a drive member for feeding the cover to a book block transported in a clamp, the drive member supplying the cover and the clamp transporting the book block forming a specific pairing; and an adhesive binding device having an evaluating and control unit in which a predetermined desired position of the cover relative to the book block is storable, in which the desired position is comparable to the actual position of the cover relative to the book block, in which a deviation of the actual position from the desired position can be determined, and in which a correction value for the specified pairing can be determined and stored, wherein prior to a renewed occurrence of the specified pairing of drive member and clamp, a change of the position of the clamp and/or the drive member of this pairing corresponding to the correction value is determined by the evaluating and control unit and can be passed on to the principal drive, connected to the evaluating and control unit, of the clamps and/or to a drive device of the cover station.

5. The device according to claim 4, wherein the drive device includes a superimposed gear unit connected to a distributing gear unit through a kingpin and an electric motor.

6. The device according to claim 5, wherein the electric motor is a step motor or a servomotor controlled by angle of rotation, which motor is connected to a motor control connected to the evaluating and control unit.

7. The device according to claim 4, further comprising a reference timing sensor connected to the principal drive and a drive member sensor for producing a pulse when passing the drive member.

8. The device according to claim 7, further comprising a reference timing generator for producing a pulse at the reference timing sensor during each machine cycle, wherein the reference timing generator is driven through a reference gear unit.

9. The device according to claim 4, further comprising a pressing station and a measuring device arranged downstream of the pressing station.

10. The device according to claim 9, wherein the measuring device is arranged between the pressing station and a release station.

* * * * *